United States Patent [19]

Mizoguchi et al.

[11] Patent Number: 4,859,254

[45] Date of Patent: Aug. 22, 1989

[54] PERMANENT MAGNET

[75] Inventors: Tetsuhiko Mizoguchi; Isao Sakai, both of Yokohama; Hiromi Niu, Tokyo; Koichiro Inomata, Yokohama, all of Japan

[73] Assignee: Kabushiki Kaisha Toshiba, Kawasaki, Japan

[21] Appl. No.: 905,397

[22] Filed: Sep. 10, 1986

[30] Foreign Application Priority Data

Sep. 10, 1985 [JP] Japan ..... 60-198530
Oct. 25, 1985 [JP] Japan ..... 60-237494
Mar. 7, 1986 [JP] Japan ..... 61-48657

[51] Int. Cl.[4] ..... H01F 1/04

[52] U.S. Cl. ..... 148/302; 420/83; 420/121; 75/244

[58] Field of Search ..... 148/302; 420/83, 121; 75/244

[56] References Cited

U.S. PATENT DOCUMENTS 4,402,770 9/1983 Koon ..... 148/302
4,533,408 8/1985 Koon ..... 148/103
4,541,877 9/1985 Stadelmaier et al. ..... 148/101

FOREIGN PATENT DOCUMENTS 0101552 2/1984 European Pat. Off. .
0106948 5/1984 European Pat. Off. .
0126802 12/1984 European Pat. Off. .
0153744 2/1985 European Pat. Off. .

OTHER PUBLICATIONS

IEEE Transactions on Magnetics, vol. MAG-21, No. 5, Sep. 1985, pp. 1955-1957.

*Primary Examiner*—John P. Sheehan
*Attorney, Agent, or Firm*—Cushman, Darby & Cushman

[57] ABSTRACT

A permanent magnet according to the present invention is characterized in that it is composed of an alloy comprising mainly of iron, and R (rare earth element including yttrium), cobalt, and boron, wherein the alloy is formed principally of ferromagnetic Fe-rich phase of tetragonal system and includes a nonmagnetic Laves phase. Compared with the prior rare earth-Fe based magnet, it has higher Curie temperature and has excellent magnetic characteristics, especially the temperature characteristics.

15 Claims, 3 Drawing Sheets

PERMANENT MAGNET

BACKGROUND OF THE INVENTION

The present invention relates to a rare earth-iron-based permanent magnet which includes a rare earth composition, boron, and iron as its principal constituents.

In the past, a rare earth-Cobalt (Co)-based magnet has been known for its high performance properties. However, since the maximum energy product $(BH)_{max}$ of the rare earth-Co-based magnet is not large enough, being about 30 MGOe at the most, the strong demand in recent years for more compactness and higher performance in electronic devices makes it desirable to develop a permanent magnet with higher performance. In response to such a demand, development has been ongoing for a permanent magnet that has iron as its principal constituent (as taught in European patent application No. 101552, U.S. Pat. No. 4,402,770, U.S. Pat. No. 4,533,408, U.S. Pat. No. 4,541,877, and others). The iron based permanent magnet includes a rare-earth element (R) such as neodymium (Nd) and boron (B), with the balance essentially of iron (Fe). It makes use of Fe which is less expensive than Co as the principal ingredient, and is capable of producing $(BH)_{max}$ that can exceed 30 MGOe. Therefore, it represents an extremely promising material that can provide a high performance magnet at low cost.

The drawback of the iron-based permanent magent is that the Curie temperature (Tc) is low compared with the rare earth-Co-based permanent magnet, and has inferior temperature versus magnetic characteristics. This will become a serious problem when it is to be used for a DC brushless motor or the like that is operated under harsh conditions such as high temperature and hence an improvement on this aspect has been desired.

As such an improvement, there has been proposed a composition such as R-B-Co-Al-Fe (EPA 106948). The present inventors have also an application 773,547 filed in 1985 now U.S. Pat. No. 4,664,724. However, the addition of Co brings about a deterioration in the magnetic characteristics so that a demand is strong for improving the performance of the rare earth-Fe-based permanent magnet, with development efforts under way at various laboratories.

SUMMARY OF THE INVENTION

An object of the present invention is to provide a rare earth-Fe-based permanent magnet which has a high Curie temperature (Tc) and excellent magnetic characteristics.

Another object of the present invention is to provide a rare earth-Fe-based permanent magnet in which magnetic characteristics have a small temperature dependence.

Still further object of the present invention is to provide a permanent magnet whose powdered alloy has an excellent oxidation-resistance.

The permanent magnet of the present invention includes an alloy that has a largest amount of iron and includes cobalt, boron, and material R consisting of at least one element from the group consisting of rare earth elements and yttrium. The alloy includes a ferromagnetic Fe-rich phase of a tetragonal system and a substantially entirely nonmagnetic Laves phase.

The rare earth-Fe-based permanent magnet has a ferromagnetic Fe-rich phase of a tetragonal system of $Nd_2Fe_{14}B$ type as the principal phase. The nonmagnetic Laves phase is of $Nd(Fe,Co,Al)_2$. Besides it may include a nonmagnetic R-rich phase of a cubic system such as $Nd_{97}Fe$ or $Nd_{95}Fe_5$ that has more than 90% by weight of the R component, a nonmagnetic B-rich phase of a cubic system such as $Nd_{1+\epsilon}Fe_4B_4$ (where $\epsilon$ is appropriately 0.1), and others as the constituent phases, in addition to including some oxides. The composition is similar when an R component other than Nd is used.

The addition of Co is effective in raising the Curie temperature, but it has also a disadvantage of lowering the coercive force. This is due to creation of a magnetic Laves phase. The magnetic Laves phase is considered responsible for lowering the coercive force by providing sites for nuclei for generating reversed magnetic domains.

In the present invention, the coercive force is improved as a result of converting substantially all of the Laves phase to a nonmagnetic state. Consequently, it becomes possible to obtain satisfactory magnetic characteristics while raising the Curie temperature to an optimum extent due to addition of Co. Further, the rare earth-Fe-based permanent magnet obtained in this manner is found to also possess satisfactory temperature versus magnetic characteristics. It is preferable that the nonmagnetic Laves phase account for about 2 to 10% of the alloy by volume. If the content is too high, the percentage of the principal phase, which produces the magnetic properties, is decreased, and the value of Br (residual magnetic flux density) is lowered. On the other hand, if too little Laves phase is provided, then the amount of added Co decreases, so that the Curie temperature does not rise as much as possible.

For the purpose of the present invention, all phases other than the principal phase and the Laves phase are not essential to the magnetic properties of the alloy. However, the R-rich phase has a lower melting point than the principal phase, and contributes to the enhancement of coercive force and other magnetic properties, by removing defects, foreign substances, and the like from the boundaries of the principal phase during sintering, and by reducing the number of generating sites of reversed magnetic domains. However, if the content is too much, the percentage of the principal phase is decreased and the magnetic characteristics are deteriorated. For this reason, the R-rich phase should be less than 5% by volume, preferably in the range of about 2.5 to 5% by volume.

BRIEF DESCRIPTION OF THE DRAWINGS

These and other objects and advantages of the invention will become more apparent and more readily appreciated from the following detailed description of the presently preferred exemplary embodiments of this invention taken in conjunction with the accompanying drawings, of which.

DETAILED DESCRIPTION OF THE PREFERRED EMBODIMENTS

Figure 1A:
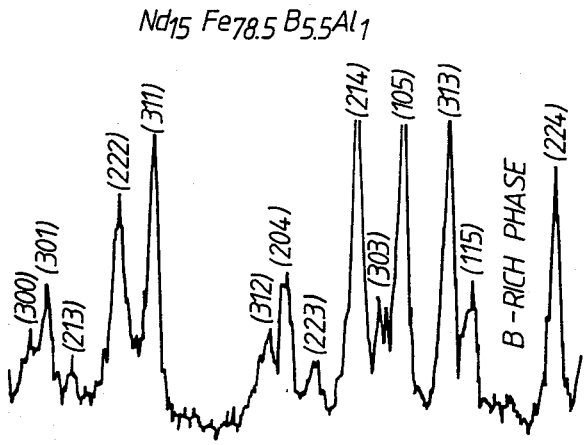
FIGS. 1(*a*)–1(*c*) show X-ray diffraction diagrams of permanent magnets.
Figure 1B:
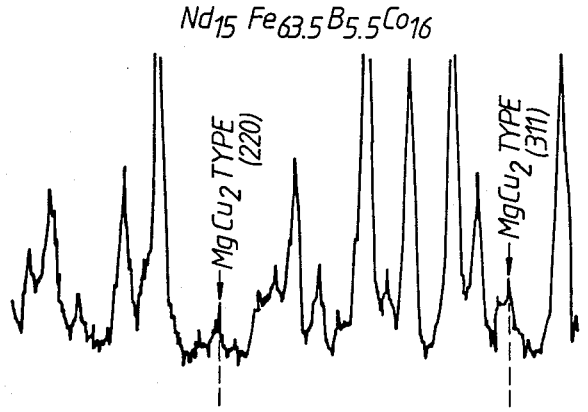
Figure 1C:
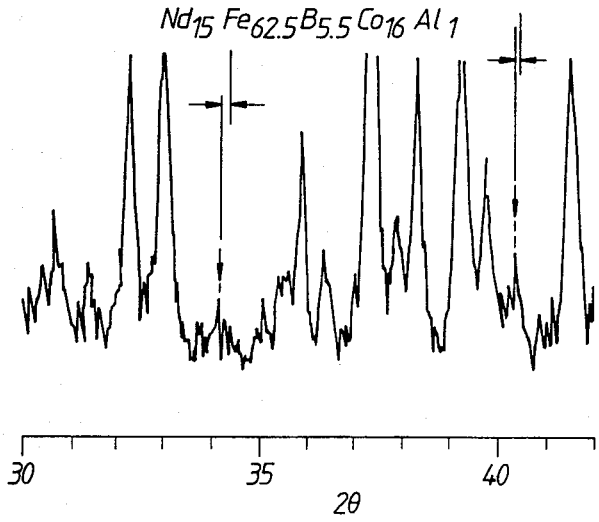

Appearance of the nonmagnetic Laves phase can be realized by adding and including a specific amount of Al, Ga, or the like to a specific composition, for example, an R-B-Co-Fe system. Examples of this are shown in FIG. 1. FIG. 1(*a*) is an X-ray diffraction diagram when no Co is added, FIG. 1(*b*) is for the case when Co alone is added, and FIG. 1(*c*) is for the case when Al is added in addition. For all of these cases, the principal phase is the Fe-rich phase. However, when Co is added, there may be observed peaks that indicate the presence of a different phase in the neighborhood of the diffraction angle $2\theta$ of 34° and 40°. By identifying the peaks by EPMA, TEM, it was found that they are (220) and (311) peaks from the $Nd(Fe, Co)_2$ cubic Laves phase of $MgCu_2$ type. Considering the fact that the ratio of Fe to Co in the Laves phase is about 1:1, it will be seen that the Curie temperature is around 100° C. and that the product possesses magnetic properties at room temperature. Moreover, in view of the fact that the coercive force of the rare earth-Fe-based permanent magnet is determined by the magnitude of the magnetic field that generates reversed magnetic domains, the magnetic Laves phase is believed to be acting as the sites for generating reversed magnetic domains.

In contrast to this, it is clear from FIG. 1(*c*) that in the present invention there exist peaks at $2\theta$ of 34° and 40°, and there are slight shifts of the peaks toward lower angles compared to the case of FIG. 1(*b*). This indicates that the lattice constant of the $Nd(Fe, Co)_2$ phase is being increased. More specifically, it is increased from 7.38 to 7.42 Angstrom. That the atomic radius of Al is large compared with 1.26 Angstrom for Fe and 1.25 Angstrom for Co indicates that Al atoms exist in the Laves phase. Since the Al atom is nonmagnetic, $Nd(Fe, Co, Al)_2$ is nonmagnetic, and since this nonmagnetic Laves phase will not become the sites of nuclei for generating the reversed magnetic domains, the coercive force will be improved as a result. It is to be noted that in place of Al such nonmagnetic elements as Re, Os, Ag, Ir, Pt, Au, Ti, V, Cu, Zn, Cr, Mn, Ga, Mo, Ru, Rh, Pd and Ta may also be added. However, when the magnetic characteristics are taken into consideration, the most effective elements will be Al and Ga. Aluminum is an element which is most effective to cause the Curie temperature of the Laves phase to drop, making the Laves phase nonmagnetic at room temperature, and which improves the coercive force. Its addition in the range of 0.1 to 5% by weight is effective. The total amount should be less than 5% by weight.

The amount of Al needed to produce a nonmagnetic Laves phase will change with the amount of Co employed. The present inventors have determined that when the following relationship exists, the Laves phase will be nonmagnetic: $(W_{Co}-9)/W_{Al} \leqq 30$, where $W_{Co}$ is the percentage by weight of Co and $W_{Al}$ is the percentage by weight of Al. When Ga is used instead of or with Al, the same relation is desirable. Here, up to 80% of Al may be replaced by Ga.

When Al is included in the Fe-rich phrase, it increases the coercive force significantly so that magnetic characteristics such as $(BH)_{max}$ and the temperature characteristics will be improved. Although a detailed mechanism for this is not yet clear, it is believed that the grain boundaries of the Fe-rich phase are cleansed by the mixing of Al. It should be noted that even when the total amount of Al is maintained the same, if the Al is concentrated in phases other than the Fe-rich phase, the above-mentioned phenomenon will not occur. It is desirable to have at least 70%, and preferably more than 80%, of the Al included in the Fe-rich phase.

Although the composition for the permanent magnet of the present invention may appropriately be set, it is desirable to employ a compositional system of R of 10 to 40% by weight, B of 0.1 to 1.25% by weight, Co of 9 to 30% by weight, with most of the balance being Fe.

When the R component is below 10% by weight, the coercive force is small, and when it exceeds 40% by weight, Br is reduced and $(BH)_{max}$ is diminished. A content in the range of 25 to 35% by weight is more desirable. Moreover, of the rare earth elements, Nd and Pr are effective for obtaining high values for $(BH)_{max}$. To include at least one of the two elements, especially Nd, as the R component is desirable. The ratio of the two elements in the R component is preferred to be more than 70% by weight.

Cobalt contributes to increase the Curie temperature, is effective for improving the temperature characteristics of the magnetic characteristics, and its addition of 9 to 30% by weight is effective. Although it is necessary to add Co at least 9% by weight to obtain a Laves phase and to obtain the full effect of the rise in the Curie temperature, it is not advisable to exceed 30% by weight in view of the magnetic characteristics that will result in decreases in the coercive force and $(BH)_{max}$. Addition of 23% or less by weight is preferred. It is desired to add no more Co than would significantly deteriorate the magnetic characteristics. However an addition of more than 9% by weight, in particular more than 13% by weight, is preferred to obtain desirable temperature characteristics.

When the amount of B is lss than 0.1% by weight, iHc falls off, and when the amount of B is more than 1.25% by weight, Br and $(BH)_{max}$ are decreased. The amount of B affects the magnetic characteristics, especially conspicuously the value of Br, and $(BH)_{max}$, so that an amount of 1.25% or less by weight, in particular 0.8 to 0.95% by weight, and more particularly 0.8 to 0.9% by weight, is preferred. As the amount of B is increased, the amount of the nonmagnetic B-rich phase will be increased also, which will result in reducing the amount of the principal phase and deteriorating the magnetic characteristics. Further, although a part of B may be substituted by C, N, Si, P, Ge, and others to improve the sintering characteristics and the like, the substituted amount should not exceed 80% by weight of the mixture including B. If the amounts of Co, B and either Al or Ga fall in the above ranges, the magnet has excellent oxidation resistance characteristics.

The content of oxygen in the permanent magnet alloy has an important significance. Since a large amount of oxygen leads to a decrease in the coercive force, it becomes impossible to obtain a large value of $(BH)_{max}$. Therefore, it is preferred to include less than 0.03% by weight. Moreover, if the content is too small, pulverization of the raw material alloy becomes difficult, resulting in a sharp increase in the cost of manufacturing. Fine pulverization which is required to be done to a particle size of about 2 to 10 μm, becomes difficult to be accomplished, and moreover, there will arise a nonuniformity in the particle diameter. Accordingly, it leads to a decrease in the value of Br that accompanies a reduction in the orientability during the formation in a magnetic field, which eventually leads also to a lowering in the value of $(BH)_{max}$. For these reasons, it is desirable to choose the content of oxygen in the range of 0.005 to 0.03% by weight.

Although the role of oxygen in the alloy is not elucidated yet, it may be considered that a high performance permanent magnet is obtained by the behavior that will be described below. Namely, a part of oxygen in molten alloy is combined with R and Fe atoms that represent the major constituents, to form oxides. These oxides are considered segregated and exist, along with the remaining oxygen, in the grain boundaries and are absorbed especially by the R-rich phase to hamper the magnetic characteristics. Taking into consideration that the rare earth-Fe-based permanent magnet consists of corpuscular magnets and its coercive force is determined by the magnetic field that generates reversed magnetic domains, it is believed that when many defects such as oxides and segregations exist, the coercive force will be decreased by the action of these defects as the generating sources of the reversed magnetic domains. On the other hand, when there are too few defects, boundary breakdown or the like does not easily take place and pulverization characteristics will be deteriorated. The oxygen content in the alloy for the permanent magnet can be controlled by the use of highly pure raw materials and by a strict control of the oxygen content in the molten raw material alloy in the furnance.

A permanent magnet in accordance with the present invention will be manufactured, for example, as follows. First, raw material alloy with the prescribed composition is crushed by a crushing means such as a ball mill. In this case, in order to facilitate formation and sintering in subsequent processes and to provide a product with satisfactory magnetic characteristics, it is desirable to crush it finely to powders with mean particle diameter of 2 to 10 μm. If the particle diameter is too large, it leads to a reduction in the coercive force. On the other hand, if it is too small, crushing becomes difficult and will result in a deterioration of magnetic characteristics such as Br.

Next, the pulverized powder of the permanent magnet alloy is pressed into a desired form. During the formation, an orientation processing is performed under application of a magnetic field of, for example, 10 kOe, similar to the case of manufacturing an ordinary sintered magnet. Following that, it is sintered at 1000° to 1200° C. for 0.5 to 5 hours. The sintering is preferably carried out in an inert gas such as Ar or in a vacuum in order not to increase the oxygen content in the alloy. Then, an aging treatment is given at 500° to 1000° C. for 0.5 to 5 hours. These conditions may be set appropriately depending upon the composition in order to induce the appearance of the nonmagnetic Laves phase.

In what follows, embodiments of the present invention will be described.

EXAMPLE 1

Elements that are combined in the composition of 0.7–1.4 wt% of B, 0.8 wt% of Al, 14.4 wt% of Co, 32.4 wt% of Nd, and essentially the remaining balance of Fe are melted by arc in a water-cooled copper hearth in an Ar atmosphere. The magnet alloy obtained (oxygen content of 0.02% by weight) is coarsely crushed in an Ar atmosphere, and is further pulverized to a grain diameter of about 3.5 μm in a jet mill.

The pulverized powder was filled into a predetermined mold, and was formed under a pressure of 2 ton/cm$^2$ while applying a magnetic field of 20 kOe. After sintering the formed body in an Ar atmosphere for one hour at 1020° to 1080° C. and rapidly cooling to room temperature, an aging treatment was given for one hour at 900° C., and again another aging treatment was given for one hour at 600° C. The magnet was then cooled rapidly to room temperature. In each of the magnets obtained, the presence of a nonmagnetic Laves phase was confirmed by X-ray diffraction. Further, the inclusion of more than 90% of Al in the Fe-rich phase was confirmed by means of XMA.

Figure 2:
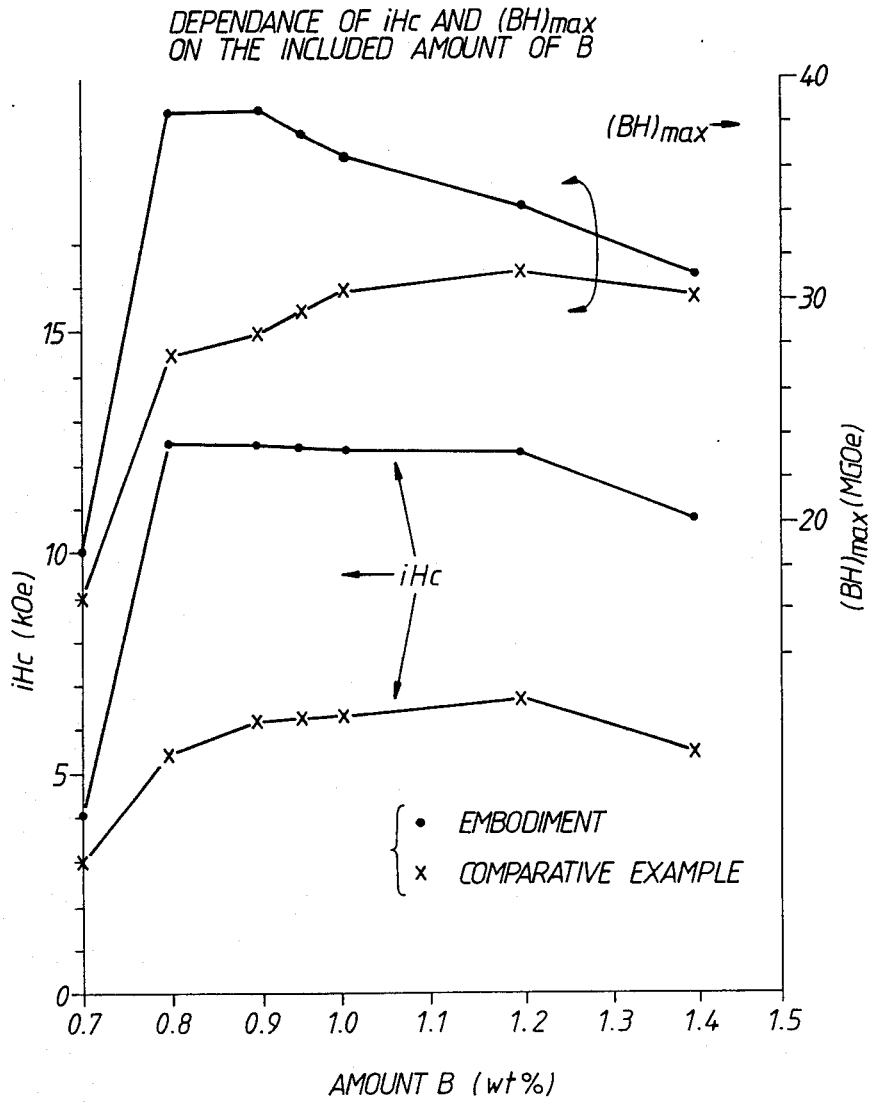
FIG. 2 is a characteristic diagram showing the relationship between the amount of B and the magnetic characteristics.

The relationship between the amount of B and iHc of $(BH)_{max}$ obtained for the manufactured magnet is shown in FIG. 2. For comparison purposes, the corresponding result for a sample with a composition of 0.7–1.4 wt% of B, 14.4 wt% of Co, 32.4 wt% of Nd, and the balance of Fe (Comparative Example 1) is also shown FIG. 2. In the comparative example, there was not observed the presence of a nonmagnetic Laves phase, although the presence of a magnetic Laves phase was confirmed.

As is clear from FIG. 2, both of iHc and $(BH)_{max}$ are improved markedly by the presence of the nonmagnetic Laves phase, and that $(BH)_{max}$ is especially high when the amount of B is in the range of 0.8 to 0.95% by weight. Further, an excellent result of the Curie temperature of 500° C. and a temperature coefficient of −0.071%/°C. was obtained for the present example.

The characteristics for magnets with various compositions manufactured in a similar manner are presented in the following Table 1.

TABLE 1

| COMPOSITION (Weight %) | iHc (kOe) | BHmax (MGOe) | Temperature characteristic (%/deg.) | extent of non-magnetic Laves phase (Vol. %) |
|---|---|---|---|---|
| 32.8Nd—0.9B—0.5Al—14.5Co—bal. Fe (oxygen 0.015 wt %., % of Al in Fe rich phase 85%) | 11.0 | 40 | −0.071 | 4 |
| 28.3Nd—3.0Ce—0.95B—0.81Al—20.0 Co—bal. Fe (oxygen 0.025 wt %, % of Al in Fe rich phase 90%) | 13.1 | 35 | −0.068 | 8 |
| 29.7Nd—1.1Pr—0.87B—0.43Al—16.1 Co—bal. Fe (oxygen 0.03 wt %, % of Al in Fe rich phase 86%) | 12.4 | 38 | −0.070 | 4 |
| 33.5Nd—0.85B—1.5Al—13.0Co—bal. Fe (oxygen 0.02 wt %, % of Al in Fe rich phase 88%) | 16.3 | 34 | −0.075 | 3 |
| 30.0Nd—1.1Dy—0.83B—0.43Al—15.5 Co—bal. Fe (oxygen 0.03 wt %, % of Al in Fe rich phase 91%) | 15.7 | 36 | −0.070 | 4 |
| 32.8Nd—0.9B—1.3Ga—14.5Co—bal. Fe (oxygen 0.015 wt %, % of Ga in Fe rich phase 85%) | 12.0 | 40.3 | −0.071 | 4 |

TABLE 1-continued

| COMPOSITION (Weight %) | iHc (kOe) | BHmax (MGOe) | Temperature characteristic (%/deg.) | extent of non-magnetic Laves phase (Vol. %) |
|---|---|---|---|---|
| 28.3Nd—3.0Ce—0.95B—2.09 Ga—20.0 Co—bal. Fe (oxygen 0.025 wt %, % of Ga in Fe rich phase 90%) | 14.0 | 35.6 | −0.068 | 8 |
| 29.7Nd—1.1Pr—0.87B—1.11 Ga—16.1Co—bal. Fe (oxygen 0.03 wt %, % of Ga in Fe rich phase 86%) | 13.6 | 37.7 | −0.070 | 4 |
| 33.5Nd—0.85B—0.5Al—1.3Ga—13.0 Co—bal. Fe (oxygen 0.02 wt %, % of Ga and Al in Fe rich phase 88%) | 18.5 | 33.9 | −0.075 | 3 |
| 30.0Nd—1.1Dy—0.83B—1.12 Ga—15.5Co—bal. Fe (oxygen 0.03 wt %, % of Ga in Fe rich phase 91% | 16.0 | 36.1 | −0.070 | 4 |

As may clear from Table 1, permanent magnets obtained by the present invention show excellent characteristics.

EXAMPLE 2

The constituent phases and the magnetic characteristics for magnets with various additional compositions are shown in the following Table 2.

TABLE 2

| COMPONENT (wt %) | Magnetic Properties Br (kG) | iHc (kOe) | BHmax (MGOe) | Curie temp. of magnet (°C.) | Temperature coefficient of Br (%/deg) | Vol. % of each phase Fe rich | Laves | others | Curie temp. of Laves of Laves (°C.) |
|---|---|---|---|---|---|---|---|---|---|
| EXAMPLES | | | | | | | | | |
| 29.3Nd—0.9B—14.8Co—0.4Al—bal. Fe (oxygen 0.03 wt %) | 13.2 | 10.7 | 41.0 | 500 | −0.071 | 88 | 5 | B rich phase 1 R rich phase 6 | −40 non-magnetic |
| 29.7Nd—0.9B—14.7Co—0.82Al—bal. Fe (oxygen 0.03 wt %) | 13.0 | 12.0 | 40.0 | 490 | −0.071 | 87 | 5 | B rich phase 1 R rich phase 7 | −100 non-magnetic |
| 33.6Nd—0.93B—13.8Co—0.87Al—Nb—0.05—bal. Fe oxygen (0.03 wt %) | 12.8 | 10.4 | 39.6 | 500 | −0.070 | 84 | 4 | B rich phase 5 R rich phase 7 | −100 non-magnetic |
| 32.0Nd—1.6Dy—0.91B—13Co—0.4 Si—bal. Fe (oxygen 0.03 wt %) | 12.5 | 8.9 | 36.3 | 450 | −0.084 | 86 | 3 | B rich phase 3 R rich phase 8 | −100 non-magnetic |
| 20.4Nd—10.1Pr—0.8Dy—0.95B—20 Co—0.79Al—bal. Fe (oxygen 0.03 wt %) | 12.7 | 11.4 | 38.1 | 520 | −0.068 | 85 | 5 | B rich phase 3 R rich phase 7 | −100 non-magnetic |
| 28.4Nd—3Ce—2.3Pr—0.9B—16Co—0.4 Al—bal. Fe (oxygen 0.03 wt %) | 13.1 | 13.5 | 40.9 | 490 | −0.071 | 87 | 4 | B rich phase 1 R rich phase 8 | −100 non-magnetic |
| 29.3Nd—0.9B—14.8Co—1.0Ga—bal. Fe (oxygen 0.03 wt %) | 13.1 | 12.0 | 40.5 | 510 | −0.071 | 89 | 4 | B rich phase 1 R rich phase 6 | −40 non-magnetic |
| 29.7Nd—0.9B—14.7Co—2.12Ga—bal. Fe (oxygen 0.03 wt %) | 13.1 | 13.1 | 40.3 | 500 | −0.071 | 88 | 5 | B rich phase 1 R rich phase 6 | −100 non-magnetic |
| 33.6Nd—0.93B—13.8Co—2.25Ga—Nb0.05—bal. F3 (oxygen 0.03 wt %) | 12.7 | 12.0 | 39.4 | 510 | −0.070 | 84 | 4 | B rich phase 5 R rich phase 7 | −100 non-magnetic |
| 20.4Nd—10.1Pr—0.8Dy—0.95 B—20Co—2.04Ga—bal. Fe (oxygen 0.03 wt %) | 12.8 | 12.3 | 38.6 | 530 | −0.068 | 84 | 5 | B rich phase 3 R rich phase 8 | −100 non-magnetic |
| 28.4Nd—3Ce—2.3Pr—0.9B—16Co—0.2 Al—0.5Ga—bal. Fe (oxygen 0.03 wt %) | 13.2 | 14.4 | 41.3 | 500 | −0.071 | 86 | 5 | B rich phase 1 R rich phase 8 | −100 non-magnetic |
| COMPARATIVE EXAMPLES | | | | | | | | | |
| 33Nd—1.2B—bal. Fe | 12.6 | 11.0 | 36.1 | 310 | −0.142 | 85 | — | B rich phase 4 R rich phase 11 | — |
| 30.8Nd—1.0B—14.2Co—bal. Fe | 13.5 | 5.5 | 31.3 | 515 | −0.071 | 87 | 6 | B rich phase 1 R rich phase 1 | 150 magnetic |

As may be clear from Table 2, it is seen that the embodiments of the present invention that include non-magnetic Laves phase possess excellent magnetic characteristics.

EXAMPLE 3

Figure 3:
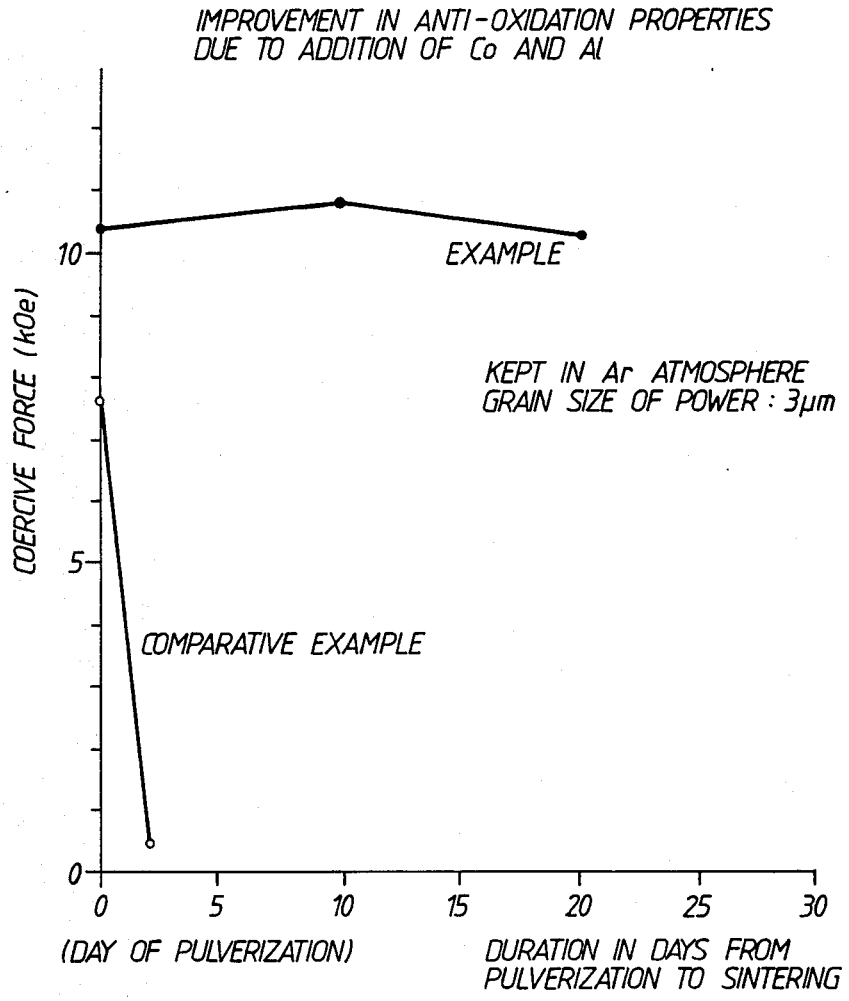
FIG. 3 is a characteristic diagram showing the relationship between the number of days from pulverization to sintering and the coercive force.

A mixture of elements in the composition of 0.9 wt% of B, 0.52 wt% of Al, 14.3 wt% of Co, 30.6 wt% of Nd, and essentially the remaining balance of Fe was melted by arc in a watercooled copper hearth in an Ar atmosphere. The magnet alloy obtained (oxygen concentration of 0.02 wt%) was coarsely) crushed in an Ar atmosphere, and was pulverized further to the grain size of about 3 μm in a jet mill. The relationship between the coercive force and the number of days from the day of pulverization to the day of sintering (kept in Ar), obtained for the magnets manufactured by similar process as shown in Example 1 using the powder obtained in the above, is shown in FIG. 3. For comparison, the corresponding relationship for a sample with composition of 0.98 wt% of B, 32.7 wt% of Nd, and the remainder of Fe (Comparative Example 2) is also shown in FIG. 3.

As may be clear from FIG. 3, in the case of Comparative Example 2, coercive force deteriorates markedly in two days after pulverization, whereas for the example of the present invention there was not observed deterioration in the coercive force.

EXAMPLE 4

An alloy for magnet with a composition of 34.6 wt% of Nd, 0.9 wt% of B, 14.1 wt% of Co, 0.4 wt% of Al, 0.02 wt% of oxygen, and essentially the remainder of Fe was prepared, and a permanent magnet was manufactured using the alloy. The magnetic characteristics and the amount of Al in the Fe-rich phases as determined by XMA are shown in Table 3.

In addition, a permanent magnet was manufactured using alloy powder obtained by mixing 0.4 g of Al powder and 100 g of powder of magnet alloy with composition of 34.4 wt% of Nd, 1.0 wt% of B, 14.2 wt% of Co, 0.02 wt% of oxygen, and the remainder of Fe. With this as a comparative example, the magnetic characteristics and the amount of Al in the Fe-rich phase as determined by XMA are shown in the following Table 3.

TABLE 3

| | % of Al in Fe-rich phase (Wt %) | Magnetic Properties Br (KG) | iHc (KOe) | $(BH)_{max}$ (MGOe) |
|---|---|---|---|---|
| Example | 82 | 13.2 | 10.4 | 40.0 |
| Comparative | 30 | 12.5 | 5.3 | 30.5 |

As may be seen from Table 3, in the case of the embodiment of the present invention in which more than 70 wt% of Al is included in the Fe-rich phase, there were obtained a large value for iHc and excellent magnetic characteristics.

Although only a few exemplary embodiments have been described in detail above, those skilled in the art will appreciate that many modifications are possible in the preferred embodiments without materially departing from the novel teachings and advantages of this invention. Accordingly, all such modifications are intended to be included within the scope of this invention as defined by the following claims.

What is claimed is:

1. A permanent magnet formed of a sintered alloy body comprising 9 to 23% by weight of cobalt, 0.1 to 1.25% by weight of boron, 0.1 to 5% by weight of aluminium, 10 to 40% by weight of material consisting of at least one element from the group consisting of rare earth elements and yttrium and the balance substantially of iron, wherein said sintered body is formed principally of a ferromagnetic Fe-rich phase of a tetragonal system and includes 2 to to 10% by volume of a nonmagnetic Laves phase.

2. The permanent magnet according to claim 1, wherein the content of B in said alloy is 0.8 to 0.95% by weight.

3. The permanent magnet according to claim 1, wherein at least 70% by weight of Al in said alloy is included in said Fe-rich phase.

4. The permanent magnet according to claim 3, wherein at least 80% by weight of Al in said alloy is included in said Fe-rich phase.

5. The permanent magnet according to claim 1, wherein any Laves phase of said alloy is effectively entirely nonmagnetic.

6. The permanent magnet according to claim 1, wherein percentage $W_{Co}$ by weight of cobalt and percentage $W_{Al}$ by weight of Al has the following relation:

$$(W_{Co}-9)/W_{Al} \leqq 30.$$

7. An alloy for permanent magnet comprising 9 to 23% by weight of cobalt, 0.1 to 1.25% by weight of boron, 0.1 to 5% by weight of aluminium, 10 to 40% by weight of material consisting of at least one element from the group consisting of rare earth elements and yttrium and the balance substantially of iron, wherein said alloy is formed principally of ferromagnetic Fe-rich phase of tetragonal system and includes 2 to 10% by volume of a nonmagnetic Laves phase.

8. The alloy for a permanent magnet according to claim 7, wherein the Laves phase of the alloy is effectively entirely nonmagnetic.

9. The alloy for a permanent magnet according to claim 7, in which the content of B is 0.8 to 0.95% by weight.

10. The alloy for a permanent magnet according to claim 7, wherein at least 70% by weight of Al is included in said Fe-rich phase.

11. The alloy for a permanent magnet according to claim 7, wherein at least 80% by weight of Al is included in said Fe-rich phase.

12. The alloy for a permanent magnet according to claim 7, wherein a percentage $W_{Co}$ by weight of cobalt and percentage $W_{Al}$ by weight of Al has the following relation:

$$(W_{Co}-9)/W_{Al} \leqq 30.$$

13. The permanent magnet according to claim 1, wherein $(BH)_{max}$ is 34 $MGO_e$ or more.

14. The alloy for a permanent magnet according to claim 7, wherein $(BH)_{max}$ is 34 $MGO_e$ or more.

15. A permanent magnet consisting essentially of 25 to 35% by weight of material R consisting of at least one element from the group consisting of rare earth elements and yttrium, 13 to 23% by weight of cobalt, 0.8 to 0.95% by weight of boron, 0.1 to 5% by weight of aluminum and the balance substantially of iron, said magnet being formed principally of a ferromagnetic Fe-rich phase of a tetragonal system and including 2 to 10% by volume of a nonmagnetic Laves phase, and having a (BH)max. of 34 MGOe or more.

* * * * *